US011369201B2

(12) United States Patent
Yu

(10) Patent No.: US 11,369,201 B2
(45) Date of Patent: Jun. 28, 2022

(54) SWINGING BASKET CHAIR WITH FOOTREST

(71) Applicant: LINHAI XINGHE ARTS & CRAFTS CO., LTD, Zhejiang (CN)

(72) Inventor: Fengming Yu, Zhejiang (CN)

(73) Assignee: LINHAI XINGHE ARTS & CRAFTS CO., LTD., Zhejiang (CN)

( * ) Notice: Subject to any disclaimer, the term of this patent is extended or adjusted under 35 U.S.C. 154(b) by 0 days.

(21) Appl. No.: 17/114,506

(22) Filed: Dec. 8, 2020

(65) Prior Publication Data

US 2022/0125202 A1 Apr. 28, 2022

(30) Foreign Application Priority Data

Oct. 22, 2020 (CN) ..... 202022367885.2

(51) Int. Cl.

| | |
|---|---|
| ***A45F 3/26*** | (2006.01) |
| ***A47C 7/50*** | (2006.01) |
| ***A47C 3/02*** | (2006.01) |
| ***A47C 3/16*** | (2006.01) |

(52) U.S. Cl.

CPC ..... *A47C 3/02* (2013.01); *A47C 3/16* (2013.01); *A47C 7/5066* (2018.08)

(58) Field of Classification Search

CPC ..... A47C 3/02; A47C 3/0255; A47C 7/5066
USPC ..... 297/277, 423.26, 423.28
See application file for complete search history.

(56) References Cited

U.S. PATENT DOCUMENTS 5,588,702 A * 12/1996 Litwin ..... A47C 3/0255 297/277
5,788,327 A * 8/1998 Gregory ..... A47C 3/0255 297/273
6,325,455 B1 * 12/2001 Chung ..... A47C 1/02 297/423.26 X
6,802,783 B1 * 10/2004 Tseng ..... A63G 9/00 472/118
6,827,650 B1 * 12/2004 Tseng ..... A63G 9/00 472/125
6,935,962 B1 * 8/2005 Tseng ..... A47C 7/52 472/125
6,949,027 B1 * 9/2005 Habing ..... A47C 3/0255 297/273 X (Continued)

FOREIGN PATENT DOCUMENTS

FR 2961675 A1 * 12/2011 ..... A45F 3/26
GB 2508369 A * 6/2014 ..... A47D 13/107
WO WO-2020104825 A1 * 5/2020 ..... A63F 13/285

*Primary Examiner* — Rodney B White
(74) *Attorney, Agent, or Firm* — JCIP Global Inc.

(57) ABSTRACT

A swinging basket chair with a footrest includes a base, a boom rod cooperatively mounted on the base, and a swinging basket hoisted on the boom rod. The footrest is cooperatively mounted at a front end of a seat portion of the swinging basket by using at least one disposed hinge component, the footrest is capable of being flipped by using the hinge component, and the footrest can be fixed at different positions. The footrest is disposed, to allow people to stretch their feet and place them on the footrest when using the swinging basket chair, thereby meeting different rest needs of users. The footrest is also mounted by using the hinge component, and the footrest can be stored below the swinging basket when not in use.

16 Claims, 8 Drawing Sheets

(56) References Cited

U.S. PATENT DOCUMENTS

| | | | | |
|---|---|---|---|---|
| 7,380,880 | B2 * | 6/2008 | Molen | A47C 3/0255 297/277 X |
| 8,430,456 | B2 * | 4/2013 | Nowak | B62B 9/102 297/423.26 X |
| 8,864,221 | B1 * | 10/2014 | Delvilla | A47C 7/624 297/423.26 X |
| 9,468,284 | B2 * | 10/2016 | Wehner | A45F 3/26 |
| 9,532,913 | B1 * | 1/2017 | Jacks | A47C 7/5066 |
| 10,631,647 | B1 * | 4/2020 | Wu | A47C 3/0255 |
| 10,912,386 | B2 * | 2/2021 | Xuemin | A47C 3/0252 |
| 2006/0061165 | A1 * | 3/2006 | Molen | A47C 3/0255 297/273 |
| 2006/0071531 | A1 * | 4/2006 | Groth | A61G 5/12 297/423.26 |
| 2007/0051858 | A1 * | 3/2007 | Bailey | A45F 3/26 248/127 |
| 2017/0013949 | A1 * | 1/2017 | Wehner | A45F 3/26 |
| 2018/0116380 | A1 * | 5/2018 | Wehner | A45F 3/26 |
| 2018/0310697 | A1 * | 11/2018 | Wehner | A47C 4/18 |
| 2020/0000232 | A1 * | 1/2020 | Lin | A47C 4/02 |

* cited by examiner

SWINGING BASKET CHAIR WITH FOOTREST

CROSS-REFERENCE TO RELATED APPLICATION

This application claims the priority benefit of China application serial no. 202022367885.2, filed on Oct. 22, 2020. The entirety of the above-mentioned patent application is hereby incorporated by reference herein and made a part of this specification.

BACKGROUND

Technical Field

The present invention belongs to the field of leisure furniture, and specifically, relates to a swinging basket chair with a footrest.

Description of Related Art

A swinging basket chair generally includes a base, a boom rod, and a swinging basket. A traditional swinging basket chair has no footrest. A user cannot stretch his feet when sitting on the chair, which is very inconvenient.

SUMMARY

In order to make up for the disadvantages of the prior art, the present invention provides a technical solution of a swinging basket chair with a footrest.

A swinging basket chair with a footrest is provided, including a base, a boom rod cooperatively mounted on the base, and a swinging basket hoisted on the boom rod, where a footrest is cooperatively mounted at a front end of a seat portion of the swinging basket by using at least one disposed hinge component, and the footrest is capable of being flipped by using the hinge component, and the footrest can be fixed at different positions.

For the swinging basket chair with the footrest, the footrest is capable of being fixed in a horizontal state, an inclined state, and a vertical state by using the hinge component, and the footrest is capable of being in the inclined state of at least one angle. When the footrest is in the vertical state, the footrest is capable of being transformed from the vertical state to the inclined state, and gradually gets inclined upwards to be transformed to the horizontal state, and the footrest is capable of being directly reset in the horizontal state to the vertical state.

For the swinging basket chair with the footrest, the hinge component includes a first connecting piece, a second connecting piece, and a resetting and locking component. One of the first connecting piece and the second connecting piece is cooperatively mounted together with the swinging basket, the other one of the first connecting piece and the second connecting piece is cooperatively mounted together with the footrest. The resetting and locking component is used such that the first connecting piece and the second connecting piece are capable of implementing flipping.

For the swinging basket chair with the footrest, the resetting and locking component includes a ratchet wheel, a pawl, a drive plate, and a torsional spring. The ratchet wheel is mounted on the second connecting piece, the pawl is mounted on the first connecting piece and is used to clamp the ratchet wheel, the torsional spring is used to provide the pawl with torsion required for clamping the ratchet wheel, and the drive plate is used to drive the pawl to remove from the ratchet wheel when the footrest is rotated to a high position, so that the footrest can be stored below the swinging basket through rotation.

For the swinging basket chair with the footrest, a first flange and a second flange are disposed on an outer edge of the drive plate. When the footrest is rotated to a high position, the second connecting piece is capable of driving the drive plate to rotate by coming into contact with one side of the first flange, so that a flange surface of the first flange drives the pawl to remove from the ratchet wheel through squeezing. When the pawl gets away from the ratchet wheel, the second connecting piece is capable of driving the drive plate to rotate by coming into contact with the second flange, so that the flange surface of the first flange no longer squeezes the pawl, and the pawl clamps the ratchet wheel again under an action of the torsional spring.

For the swinging basket chair with the footrest, teeth are provided only on a part, corresponding to the pawl, of an edge of the ratchet wheel.

For the swinging basket chair with the footrest, an inserted tooth inserted into a tooth groove of the ratchet wheel is provided on the pawl.

For the swinging basket chair with the footrest, a number of the ratchet wheel is two, and the two ratchet wheels are integrated with the second connecting piece as one piece, and the drive plate is located between the two ratchet wheels.

For the swinging basket chair with the footrest, the first connecting piece is cooperatively mounted together with the swinging basket, and the second connecting piece is cooperatively mounted together with the footrest.

For the swinging basket chair with the footrest, the first connecting piece is fixed, through insertion, together with a first fixing rod disposed on the swinging basket, and the second connecting piece is fixed, through insertion, together with a second fixing rod disposed on the footrest.

Compared with the prior art, in the present invention, the footrest is disposed, to allow people to stretch their feet and place them on the footrest when the swinging basket chair is used, thereby meeting different rest needs of users. In addition, in the present invention, the footrest is also mounted by using the hinge component, and the footrest can be stored below the swinging basket when not in use, which is very practical.

DESCRIPTION OF THE EMBODIMENTS

Figure 1:
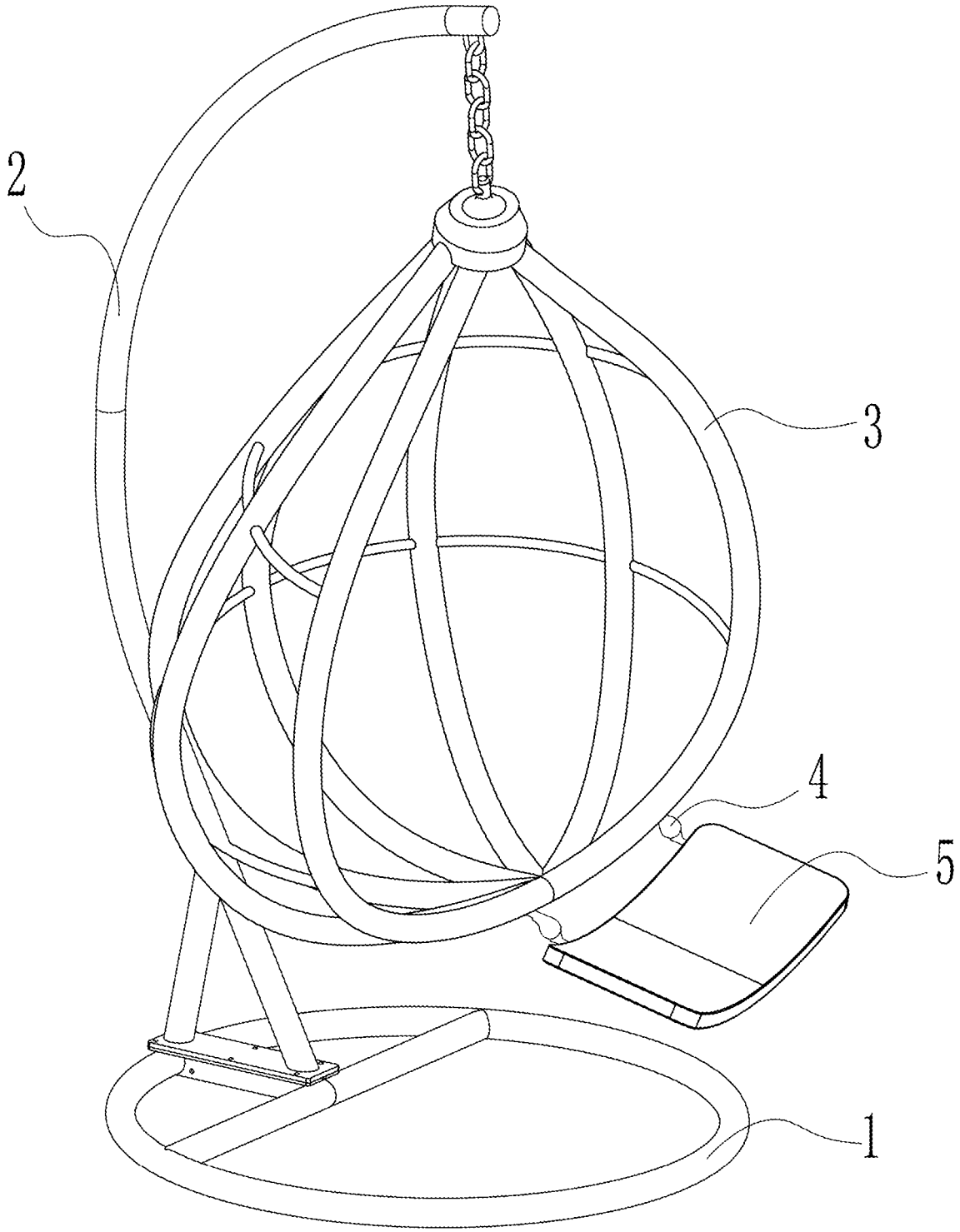
FIG. 1 is a schematic structural diagram of the present invention.
Figure 2:
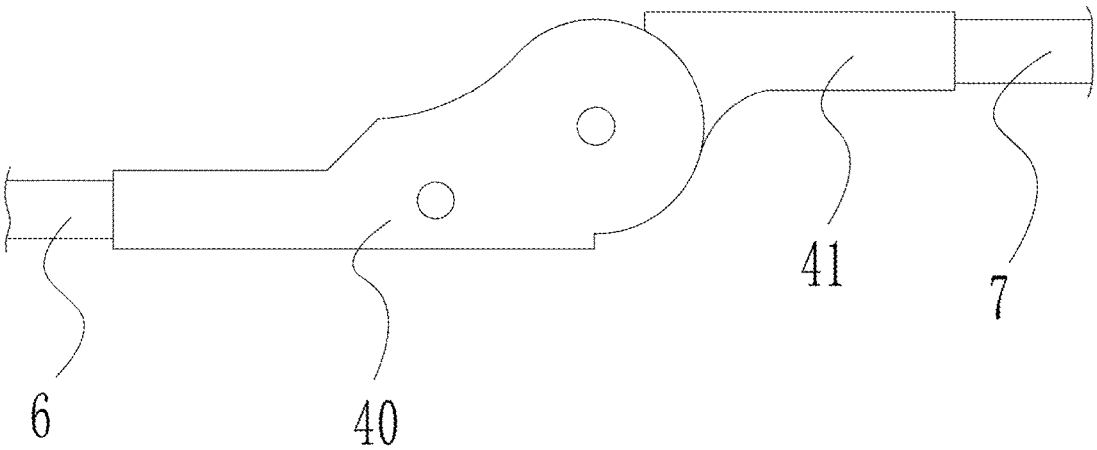
FIG. 2 is a schematic structural diagram of connecting a hinge component to a first fixing rod and a second fixing rod according to the present invention.
Figure 3:
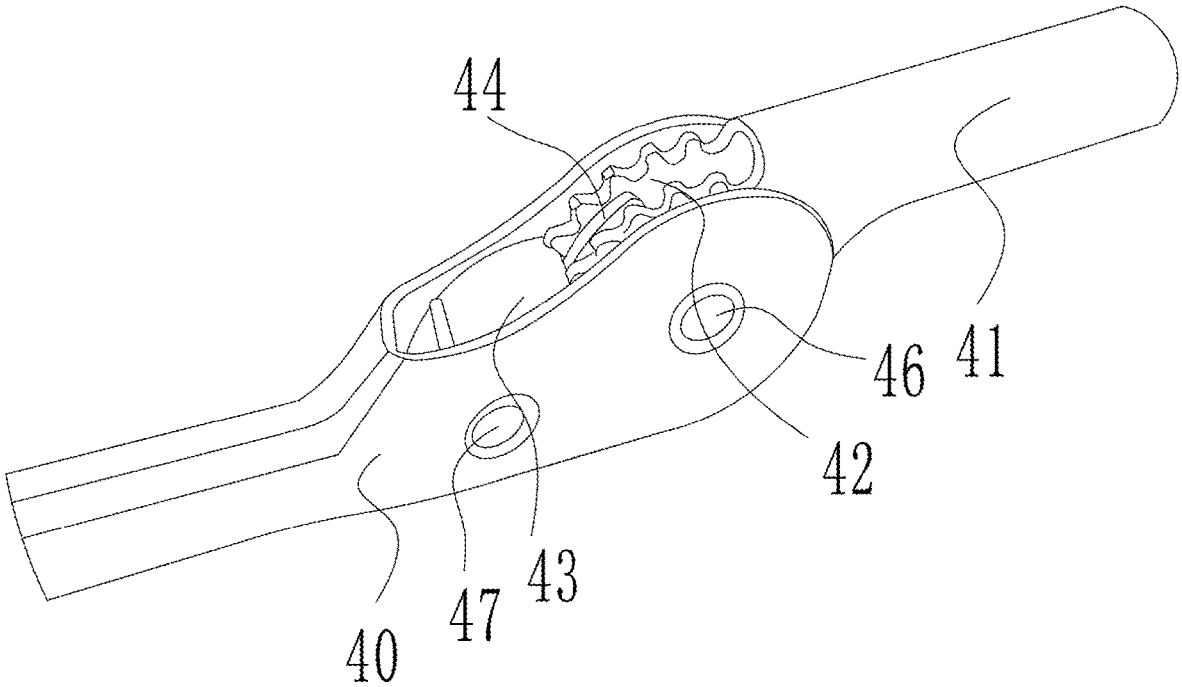
FIG. 3 is a schematic structural diagram of the hinge component according to the present invention.

In the description of the present invention, it should be understood that orientations or position relationships indicated by terms "one end", "the other end", "outside", "on", "inside", "horizontal", "coaxial", "central", "end portion", "length", "outer end", and the like are orientations or position relationships as shown in the drawings, and these terms are just used to facilitate description of the present invention and simplify the description, but not to indicate or imply that the mentioned apparatus or elements must have a specific orientation and must be established and operated in a specific orientation, and thus, these terms cannot be understood as a limitation to the present invention.

The present invention is further elaborated below with reference to the accompanying drawings.

As shown in the figures, a swinging basket chair with a footrest is provided, including a base 1, a boom rod 2 cooperatively mounted on the base 1, and a swinging basket 3 hoisted on the boom rod 2. The footrest 5 is cooperatively mounted at a front end of a seat portion of the swinging basket 3 by using at least one disposed hinge component 4, and the footrest 5 is capable of being flipped by using the hinge component 4, and the footrest 5 can be fixed at different positions.

The footrest 5 is capable of being fixed in a horizontal state, an inclined state, and a vertical state by using the hinge component 4, and the footrest 5 is capable of being in an inclined state of at least one angle. When the footrest 5 is in the vertical state, the footrest 5 is capable of being transformed from the vertical state to the inclined state, and gradually gets inclined upwards to be transformed to the horizontal state. The footrest 5 is capable of being directly reset in the horizontal state to the vertical state.

The hinge component 4 includes a first connecting piece 40, a second connecting piece 41, and a resetting and locking component. One of the first connecting piece 40 and the second connecting piece 41 is cooperatively mounted together with the swinging basket 3, and the other is cooperatively mounted together with the footrest 5. The resetting and locking component is used such that the first connecting piece 40 and the second connecting piece 41 are capable of implementing flipping. Preferably, the first connecting piece 40 is cooperatively mounted together with the swinging basket 3, and the second connecting piece 41 is cooperatively mounted together with the footrest 5.

The resetting and locking component includes a ratchet wheel 42, a pawl 43, a drive plate 44, and a torsional spring 45. The ratchet wheel 42 is cooperatively mounted on the second connecting piece 41, the pawl 43 is cooperatively mounted on the first connecting piece 40 and is used to clamp the ratchet wheel 42, the torsional spring 45 is used to provide the pawl 43 with torsion required for clamping the ratchet wheel 42, and the drive plate 44 is used to drive the pawl 43 to remove from the ratchet wheel 42 when the footrest 5 is rotated to a high position, so that the footrest 5 can be stored below the swinging basket 3 through rotation.

As an optimization, the first connecting piece 40, the ratchet wheel 42, and the drive plate 44 rotatably cooperate by using a first pin shaft 46. The pawl 43 is mounted on the first connecting piece 40 by using a second pin shaft 47.

Figure 5:
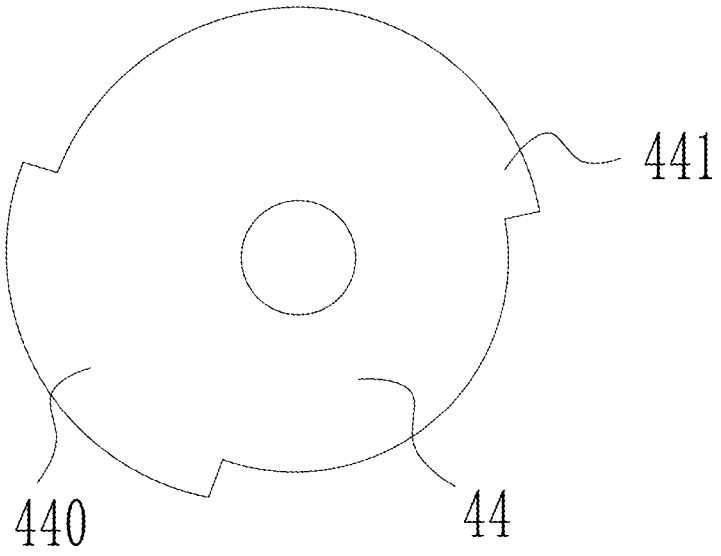
FIG. 5 is a structural schematic diagram of a drive plate according to the present invention.
Figure 6:
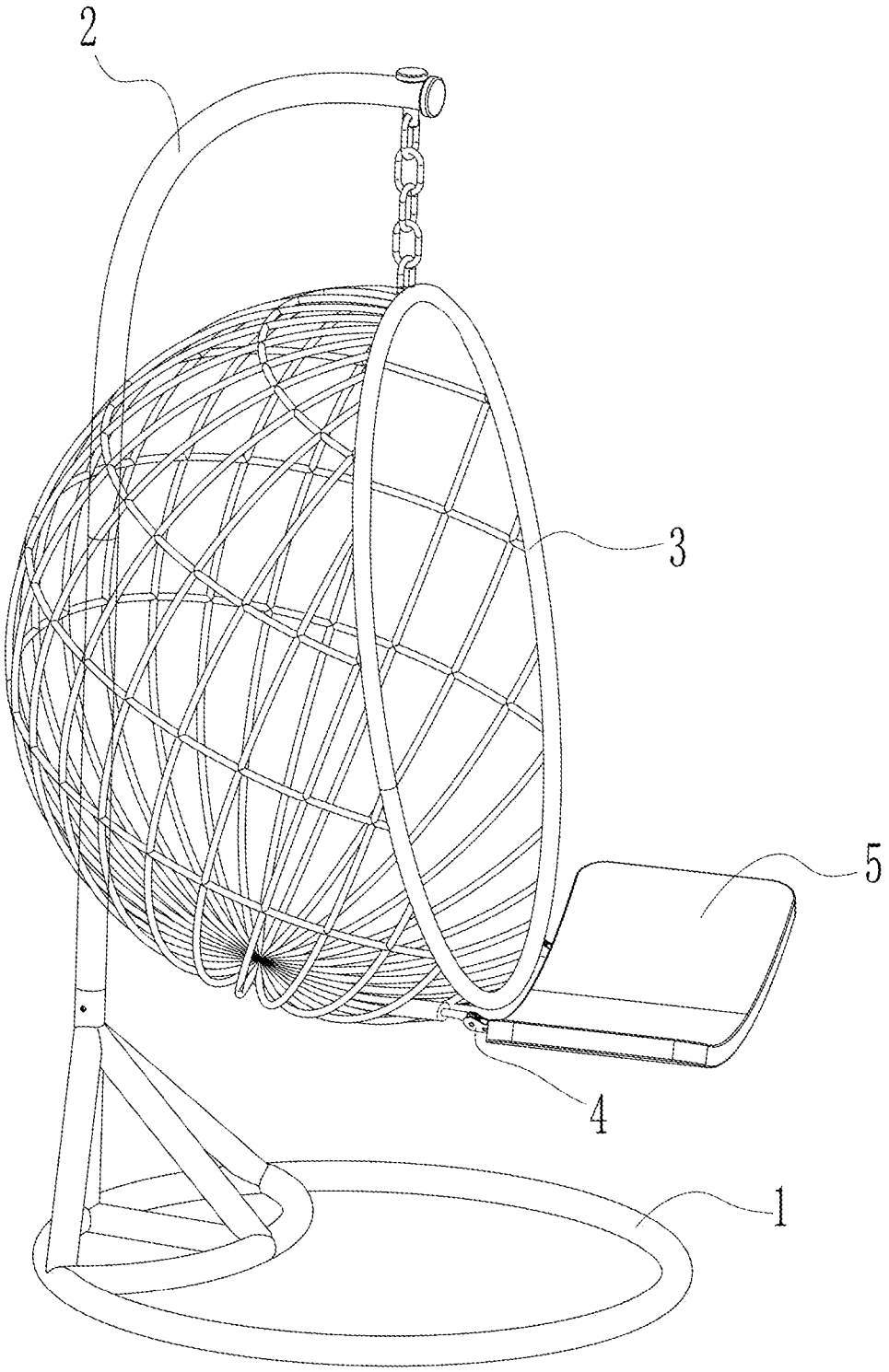
FIG. 6 is a schematic structural diagram of a second implementation according to the present invention.
Figure 7:
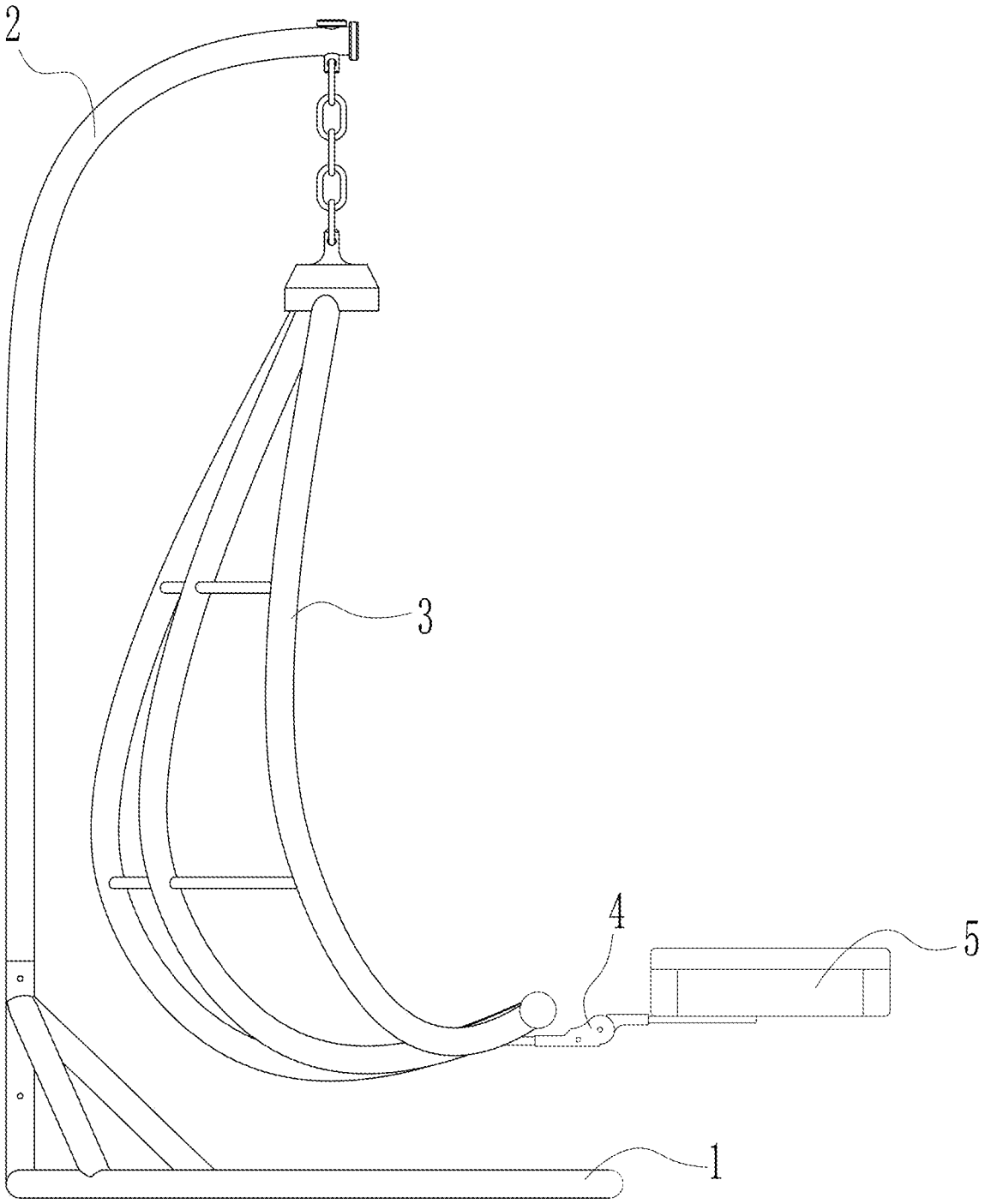
FIG. 7 is a schematic structural diagram of a third implementation according to the present invention.
Figure 8:
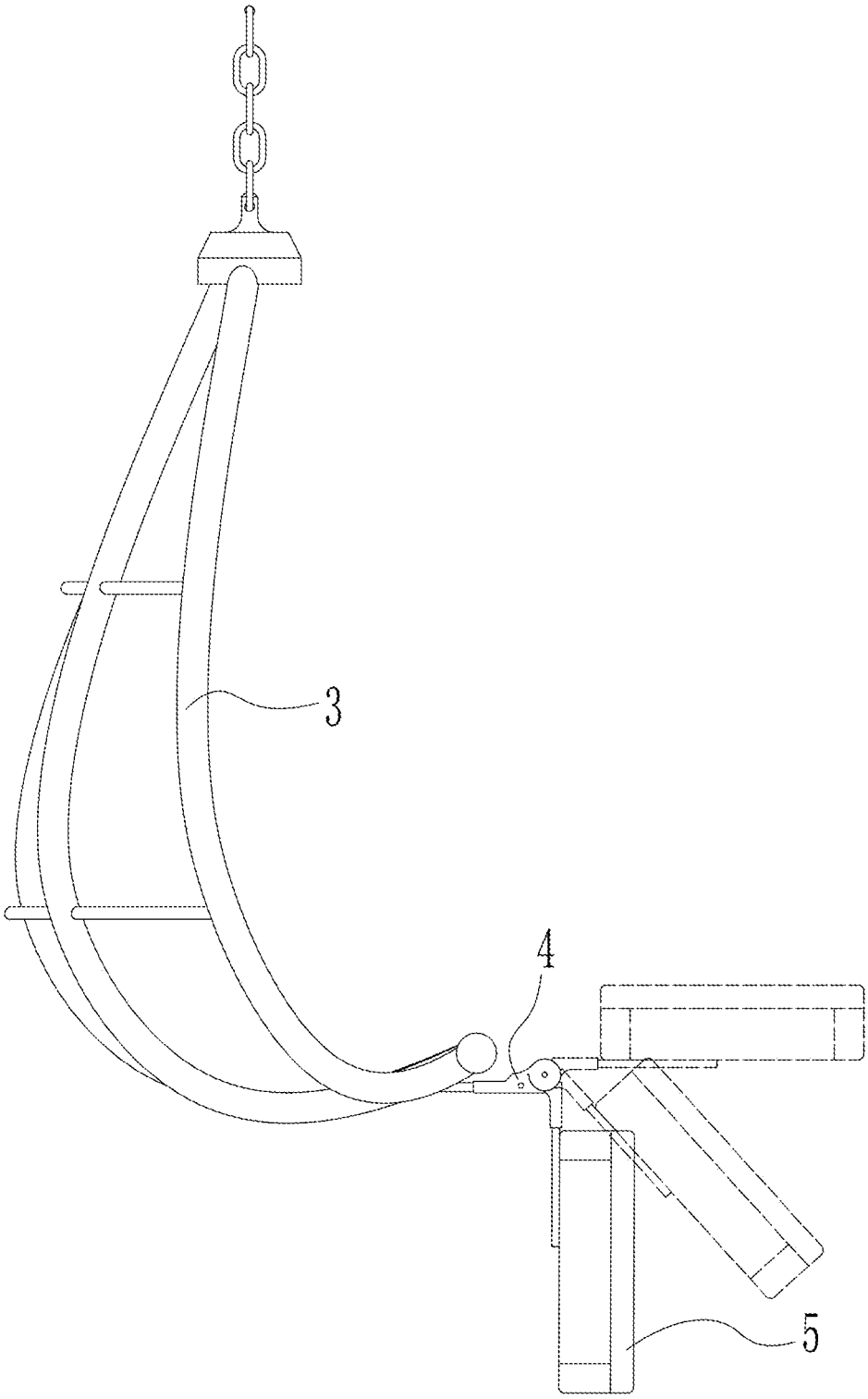
FIG. 8 is a schematic structural diagram when a footrest is flipped in a third implementation according to the present invention.
Figure 9:
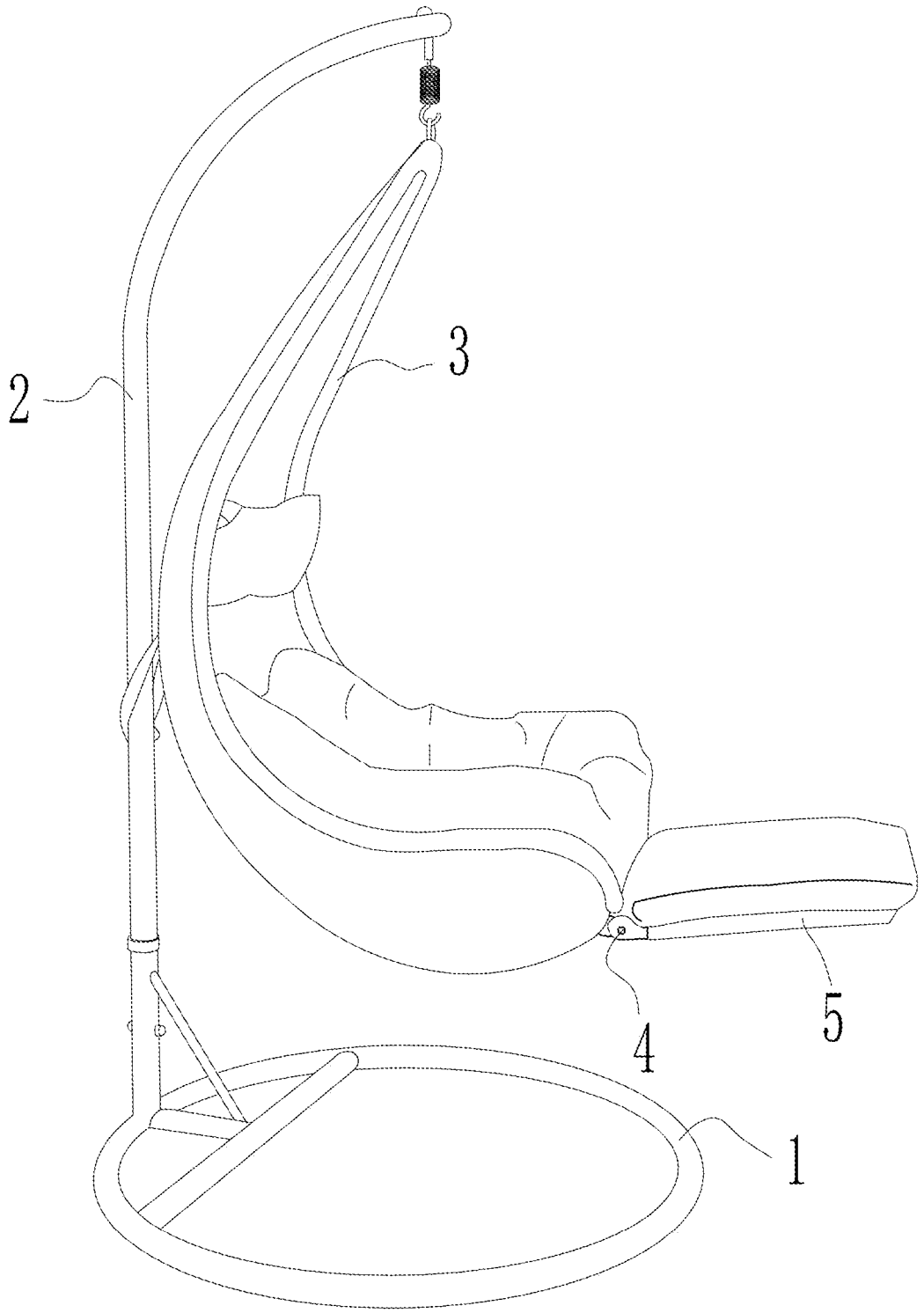
FIG. 9 is a schematic structural diagram of a fourth implementation according to the present invention.
Figure 10:
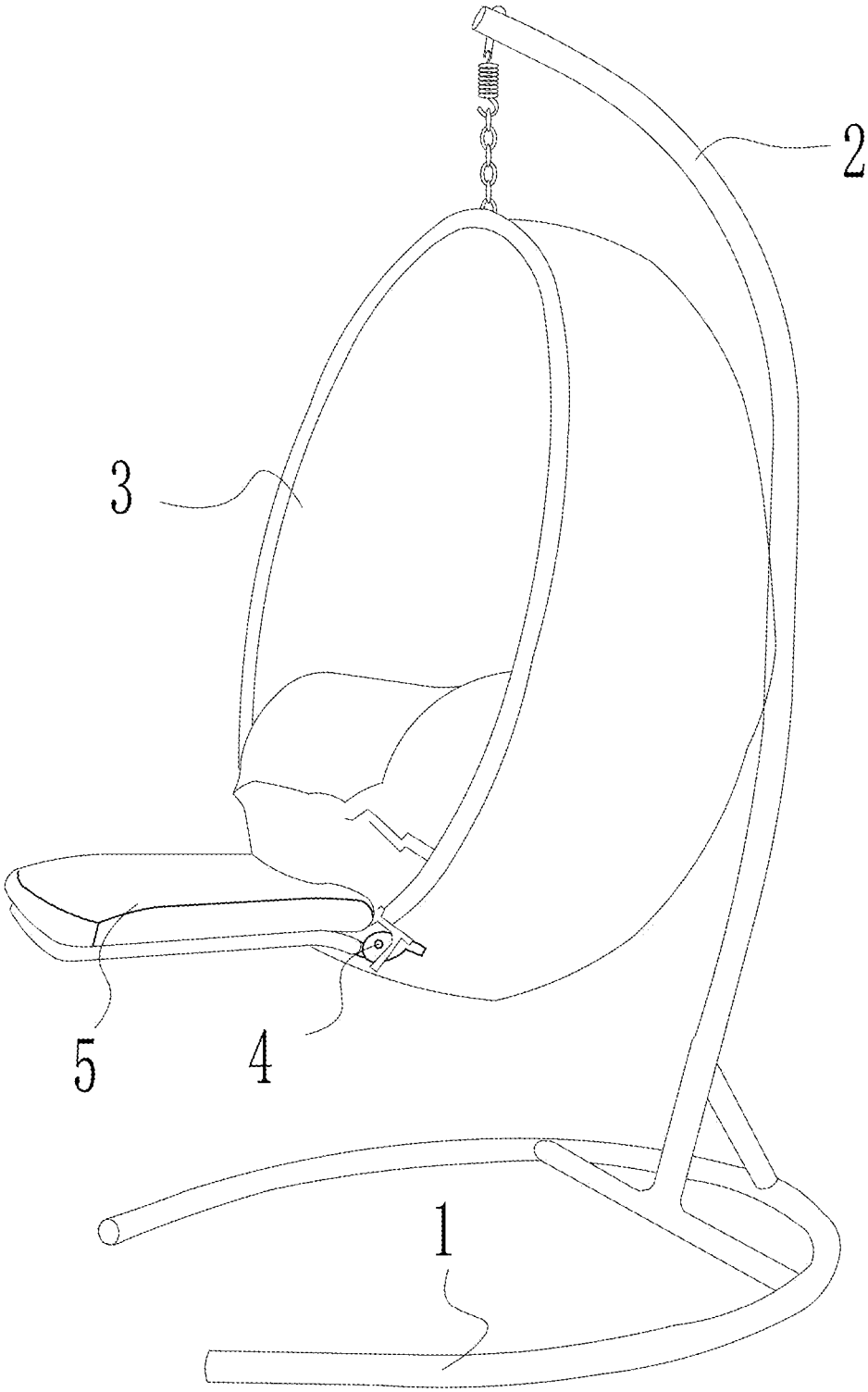
FIG. 10 is a schematic structural diagram of a fifth implementation according to the present invention.

Further, a first flange 440 and a second flange 441 are disposed on an outer edge of the drive plate 44, the first flange 440 is fan shaped, and the second flange 441 is crescent shaped with a pointed end and a flat end. The pointed portion is integrated together with the drive plate 44, and therefore, is invisible in FIG. 5. When the footrest 5 is rotated to a high position, the second connecting piece 41 is capable of driving the drive plate 44 to rotate by coming into contact with one side of the first flange 440, so that a flange surface of the first flange 440 drives the pawl 43 to remove from the ratchet wheel 42 through squeezing. When the pawl 43 gets away from the ratchet wheel 42, the second connecting piece 41 is capable of driving the drive plate 44 to rotate by coming into contact with the second flange 441, so that the flange surface of the first flange 440 no longer squeezes the pawl 43, and the pawl 43 clamps the ratchet wheel 42 again under an action of the torsional spring 45.

As an optimization, teeth are provided only on a part, corresponding to the pawl 43, of an edge of the ratchet wheel 42.

As an optimization, an inserted tooth 430 inserted into a teeth groove of the ratchet wheel 42 is provided on the pawl 43.

As an optimization, a number of the ratchet wheel 42 is two, and the two ratchet wheels 42 are integrated with the second connecting piece 41 as one piece. The drive plate 44 is located between the two ratchet wheels 42.

As an optimization, the first connecting piece 40 is fixed, through insertion, together with a first fixing rod 6 disposed on the swinging basket 3, and the second connecting piece 41 is fixed, through insertion, together with a second fixing rod 7 disposed on the footrest 5.

In the present invention, the horizontal state is a state when the footrest 5 is horizontally used. Generally, the horizontal state is a state in which the footrest 5 is at a highest fixable position, and is not limited to an absolute horizontal plane state. The vertical state is a state in which the footrest 5 is folded. Generally, the vertical state is a lowest fixable position that can be flipped, and is not limited to an absolute vertical plane state. The inclined state may be inclined by one or more levels. Usually, flipping is performed by using the resetting and locking component as a shaft core. The resetting and locking component may also be a chuck, a bayonet locking component, and the like commonly used in the prior art. The footrest 5 may be further completely flipped to a bottom portion surface of the swinging basket 3 for storage, and may be bound by using a component such as a hook or a lanyard.

Figure 4:
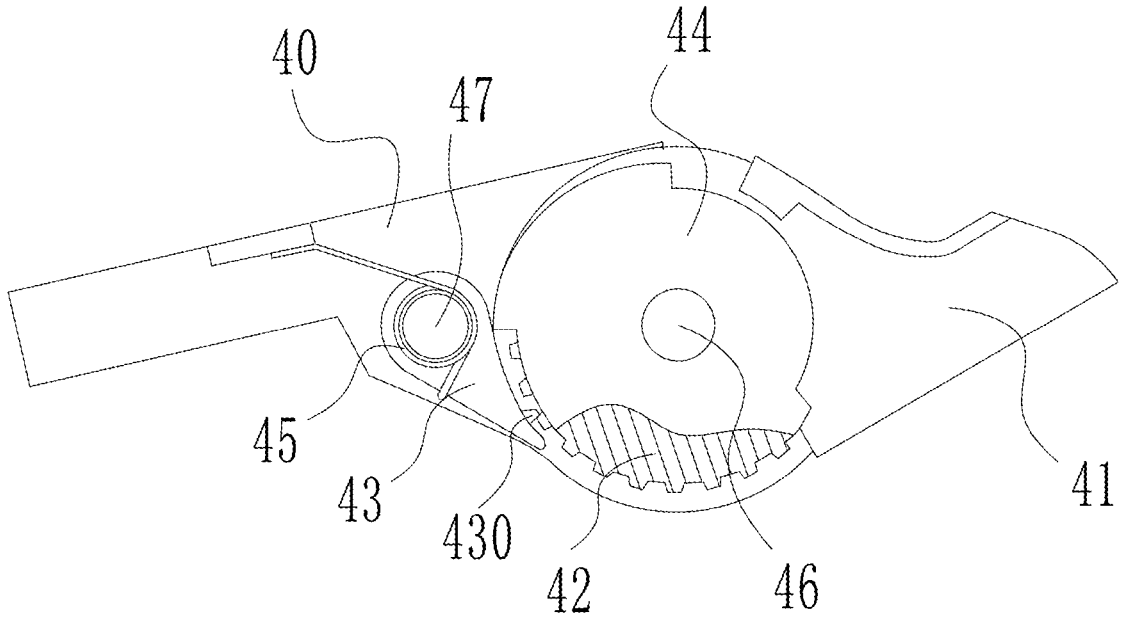
FIG. 4 is a schematic diagram of an internal structure of the hinge component according to the present invention.

With reference to FIG. 4, a working process of the present invention is described as follows. The footrest 5 is pulled up and drives the second connecting piece 41 to rotate, and rotation of the second connecting piece 41 drives the ratchet wheel 42 to rotate. The inserted tooth 430 of the pawl 43 is inserted into a corresponding one of the tooth groove of the ratchet wheel 42 during each step of the rotation of the ratchet wheel 42, so as to clamp the ratchet wheel 42 to fix the footrest 5. When the footrest 5 is pulled to the horizontal state, a foot may be placed on the footrest 5. When the footrest 5 needs to be put down, continuously pulling the footrest 5 up to a certain angle (for example, 10°-30° above the horizontal state), such that the footrest 5 drives the second connecting piece 41 to rotate counterclockwise, and the second connecting piece 41 comes into contact with a right side of the first flange 440 of the drive plate 44, to drive the drive plate 44 to rotate counterclockwise. During the rotation, a left side of the first flange 440 of the drive plate 44 squeezes the pawl 43, to make the pawl 43 to remove from the ratchet wheel 42. In this case, the inserted tooth 430 of the pawl 43 is in contact with an outer flange surface of the first flange 440. Under an action of the torsional spring 45, there is certain frictional force between the inserted tooth 430 and the outer flange surface of the first flange 440. Then the footrest 5 is pulled down, and the footrest 5 drives the second connecting piece 41 to rotate clockwise. During the rotation, the second connecting piece 41 comes into contact with the second flange 441 and drives the drive plate 44 to rotate clockwise by squeezing the second flange 441. The first flange 440 of the drive plate 44 no longer comes into contact with the inserted tooth 430. Therefore, the inserted tooth 430 is inserted into the tooth groove of the ratchet wheel 42 again, so that the footrest 5 is fixed again.

At last, it should be noted that the above various embodiments are only used to illustrate the technical solutions of the present invention without limitation; and despite reference to the aforementioned embodiments to make a detailed description of the present invention, those of ordinary skilled in the art should understand. The described technical solutions in above various embodiments may be modified or the part of or all technical features may be equivalently substituted; while these modifications or substitutions do not make the essence of their corresponding technical solutions deviate from the scope of the technical solutions of the embodiments of the present invention.

What is claimed is:

1. A swinging basket chair with a footrest, the swinging basket chair comprising a base, a boom rod cooperatively mounted on the base, and a swinging basket hoisted on the boom rod, wherein a footrest is cooperatively mounted at a front end of a seat portion of the swinging basket by at least one hinge component, and the footrest is capable of being flipped by the hinge component, and the footrest is able to be fixed at different positions, wherein the footrest is capable of being fixed in a horizontal state, an inclined state, and a vertical state by the hinge component;

the hinge component comprises a first connecting piece, a second connecting piece, and a resetting and locking component, wherein one of the first connecting piece and the second connecting piece is cooperatively mounted together with the swinging basket, the other one of the first connecting piece and the second connecting piece is cooperatively mounted together with the footrest; and the resetting and locking component comprises a ratchet wheel, a pawl, a drive plate, and a torsional spring, wherein the ratchet wheel is cooperatively mounted on the second connecting piece, the pawl is cooperatively mounted on the first connecting piece and is configured to clamp the ratchet wheel, the torsional spring provides the pawl with torsion required for clamping the ratchet wheel, and the drive plate drives the pawl to remove from the ratchet wheel when the footrest is rotated to a highest position, so that the footrest is able to be stored below the swinging basket through rotation.

2. The swinging basket chair with the footrest according to claim 1, wherein a first flange and a second flange are disposed on an outer edge of the drive plate, and when the footrest is rotated to the highest position, the second connecting piece is capable of driving the drive plate to rotate by contact with one side of the first flange, so that a flange surface of the first flange drives the pawl to remove from the ratchet wheel through squeezing; when the pawl removes from the ratchet wheel, the second connecting piece is capable of driving the drive plate to rotate by contact with the second flange, so that the flange surface of the first flange no longer squeezes the pawl, and the pawl clamps the ratchet wheel again under an action of the torsional spring.

3. The swinging basket chair with the footrest according to claim 2, wherein the first connecting piece is cooperatively mounted together with the swinging basket, and the second connecting piece is cooperatively mounted together with the footrest.

4. The swinging basket chair with the footrest according to claim 3, wherein the first connecting piece is fixed, through insertion, together with a first fixing rod disposed on the swinging basket, and the second connecting piece is fixed, through insertion, together with a second fixing rod disposed on the footrest.

5. The swinging basket chair with the footrest according to claim 1, wherein teeth are provided only on a part, corresponding to the pawl, of an edge of the ratchet wheel.

6. The swinging basket chair with the footrest according to claim 5, wherein the first connecting piece is cooperatively mounted together with the swinging basket, and the second connecting piece is cooperatively mounted together with the footrest.

7. The swinging basket chair with the footrest according to claim 6, wherein the first connecting piece is fixed, through insertion, together with a first fixing rod disposed on the swinging basket, and the second connecting piece is fixed, through insertion, together with a second fixing rod disposed on the footrest.

8. The swinging basket chair with the footrest according to claim 1, wherein an inserted tooth inserted into a tooth groove of the ratchet wheel is provided on the pawl.

9. The swinging basket chair with the footrest according to claim 8, wherein the first connecting piece is cooperatively mounted together with the swinging basket, and the second connecting piece is cooperatively mounted together with the footrest.

10. The swinging basket chair with the footrest according to claim 9, wherein the first connecting piece is fixed, through insertion, together with a first fixing rod disposed on the swinging basket, and the second connecting piece is fixed, through insertion, together with a second fixing rod disposed on the footrest.

11. The swinging basket chair with the footrest according to claim 1, wherein a number of the ratchet wheel is two, the ratchet wheels are integrated with the second connecting piece as one piece, and the drive plate is located between the two ratchet wheels.

12. The swinging basket chair with the footrest according to claim 11, wherein the first connecting piece is cooperatively mounted together with the swinging basket, and the second connecting piece is cooperatively mounted together with the footrest.

13. The swinging basket chair with the footrest according to claim 12, wherein the first connecting piece is fixed, through insertion, together with a first fixing rod disposed on the swinging basket, and the second connecting piece is fixed, through insertion, together with a second fixing rod disposed on the footrest.

14. The swinging basket chair with the footrest according to claim 1, wherein the first connecting piece is cooperatively mounted together with the swinging basket, and the second connecting piece is cooperatively mounted together with the footrest.

15. The swinging basket chair with the footrest according to claim 14, wherein the first connecting piece is fixed, through insertion, together with a first fixing rod disposed on the swinging basket, and the second connecting piece is fixed, through insertion, together with a second fixing rod disposed on the footrest.

16. A swinging basket chair with a footrest, the swinging basket chair comprising a base, a boom rod cooperatively mounted on the base, and a swinging basket hoisted on the boom rod, wherein a footrest is cooperatively mounted at a front end of a seat portion of the swinging basket by at least one hinge component, and the footrest is capable of being flipped by the hinge component, and the footrest is able to be fixed at different positions, wherein the footrest is capable of being fixed in a horizontal state, an inclined state, and a vertical state by the hinge component;

the hinge component comprises a first connecting piece, a second connecting piece, and a resetting and locking component, wherein the first connecting piece is fixed, through insertion, together with a first fixing rod disposed on the swinging basket, the second connecting piece is fixed, through insertion, together with a second fixing rod disposed on the footrest, and the resetting and locking component is configured to allow the first connecting piece and the second connecting piece to be capable of flipping with each other.

* * * * *